US011745502B2

(12) United States Patent
Gracia Verdugo et al.

(10) Patent No.: US 11,745,502 B2
(45) Date of Patent: Sep. 5, 2023

(54) PRINTHEAD NOZZLE USAGE

(71) Applicant: Hewlett-Packard Development Company, L.P., Spring, TX (US)

(72) Inventors: Antonio Gracia Verdugo, Sant Cugat del Valles (ES); Andreu Vinets Alonso, Sant Cugat del Valles (ES); Andrei Alexandru Dafinoiu, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/419,345

(22) PCT Filed: Jul. 15, 2019

(86) PCT No.: PCT/US2019/041866
§ 371 (c)(1),
(2) Date: Jun. 29, 2021

(87) PCT Pub. No.: WO2021/010975
PCT Pub. Date: Jan. 21, 2021

(65) Prior Publication Data

US 2022/0126571 A1 Apr. 28, 2022

(51) Int. Cl.
*B41J 2/045* (2006.01)
*B41J 2/21* (2006.01)

(52) U.S. Cl.
CPC ..... *B41J 2/04536* (2013.01); *B41J 2/0451* (2013.01); *B41J 2/2139* (2013.01)

(58) Field of Classification Search
CPC ..... B41J 2/04536; B41J 2/0451; B41J 2/2139
See application file for complete search history.

(56) References Cited

U.S. PATENT DOCUMENTS

| | | | | |
|---|---|---|---|---|
| 5,929,875 | A | 7/1999 | Su et al. | |
| 6,332,662 | B1 | 12/2001 | Choi | |
| 6,814,422 | B2 | 11/2004 | Bruch et al. | |
| 6,962,399 | B2 | 11/2005 | Anderson et al. | |
| 8,511,788 | B2 * | 8/2013 | Inoue | B41J 29/393 347/19 |
| 9,914,309 | B2 | 3/2018 | Billow et al. | |
| 2006/0227157 | A1 | 10/2006 | Drake et al. | |
| 2015/0336384 | A1 | 11/2015 | Silverbrook et al. | |
| 2016/0067427 | A1 | 3/2016 | Ma et al. | |

FOREIGN PATENT DOCUMENTS

| | | | |
|---|---|---|---|
| EP | 1157840 | A2 | 11/2001 |

* cited by examiner

*Primary Examiner* — Thinh H Nguyen

(57) ABSTRACT

In an example, a printing apparatus includes a controller, wherein the controller may be to compare a historic usage of a first printhead nozzle with a historic usage of a second printhead nozzle which is located on a same printhead as the first nozzle. The controller may be to determine that the historic usage of the first nozzle is higher than the historic usage of the second nozzle, and in response identify a currently operational third printhead nozzle, for which the second nozzle is able to compensate; and turn off the third nozzle, and operate the second nozzle at a higher firing frequency to compensate for the third nozzle.

19 Claims, 4 Drawing Sheets

PRINTHEAD NOZZLE USAGE

BACKGROUND

Print apparatus utilise various techniques to disperse print agents such as coloring agents, for example comprising a dye or colorant coating agents, thermal absorbing agents and the like. Some apparatus may use 'inkjet' techniques and such apparatus may comprise a printhead. An example printhead includes a set of nozzles and a mechanism for ejecting a selected print agent (for example, an ink) as a fluid, for example a liquid, through a nozzle.

BRIEF DESCRIPTION OF THE DRAWINGS

Non-limiting examples will now be described with reference to the accompanying drawings, in which.

DETAILED DESCRIPTION

Figure 1:
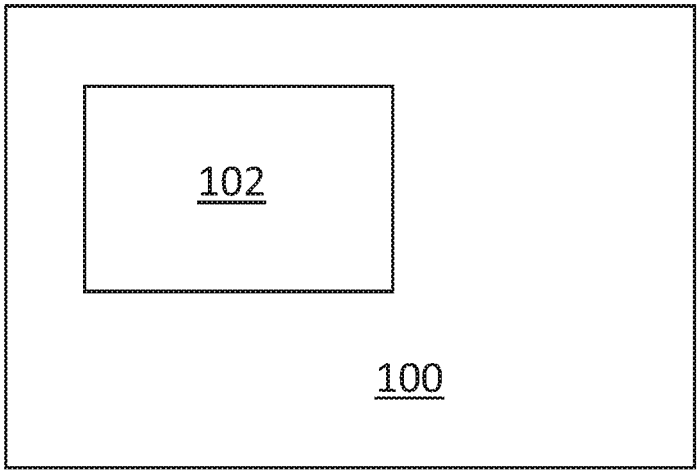
FIG. 1 shows a simplified schematic drawing of an example printing apparatus.

FIG. 1 shows an example of a print apparatus 100 which may, for example, be for two-dimensional printing, e.g. ink-jet printing (for example for applying drops of a print agent such as ink on to a substrate such as paper, card, plastic, metal or the like) or three-dimensional printing (for example, applying drops of print agents which cause selective fusing or coloring of a build material, for example a powdered build material such as a plastic powder). The print apparatus 100 comprises a controller 102. The controller may be to control operation of nozzles positioned on a printhead of a printer. The print apparatus 100 may form part of such a printer or may be in communication with a printer, for example over a wired or wireless connection. In some examples the print apparatus may comprise a carriage for receiving a printhead. The controller 102 is to compare a historic usage of a first printhead nozzle with a historic usage of a second printhead nozzle, located on a same printhead as the first nozzle. Historic usage may comprise data indicating how frequently the nozzle has been used in its lifetime so far. For example, historic usage data may comprise parameters such as a total amount of drops fired from the nozzle, firing frequency of the nozzle and how long the nozzle has operated for at particular firing frequencies. Historic usage may be based on a continuously or periodically tracked usage of the nozzle over the lifetime of the nozzle or within a particular time period. Historic usage of a particular nozzle may be a relative historic usage, relative to the usage of other nozzles located on the same printhead. In some examples, usage may be represented by the number of times a nozzle has been used to replace another nozzle. For example, if a nozzle has fired 20 drops due to normal usage and 5 drops to compensate for a malfunctioning nozzle then the usage level would be 5 and the controller would then search for opportunities to compensate for this nozzle 5 times to balance its usage. The controller 102 is further to determine that historic usage of the first nozzle is higher than historic usage of the second nozzle. For example, the first nozzle may have been operating at a higher firing frequency (e.g. twice its usual firing frequency) to compensate for another malfunctioning nozzle, i.e. to provide error hiding and extra robustness against nozzle firing issues. That is, the first nozzle may have been printing image points intended for printing by the first nozzle while also printing image points intended for printing by another nozzle, which is malfunctioning. If the first nozzle continues to operate at a higher frequency than the second nozzle for a long time then the first nozzle may wear out before the second nozzle Therefore, in response to determining that the historic usage of the first nozzle is higher than the historic usage of the second nozzle, the controller 102 is to identify a currently operational third printhead nozzle, for which the second nozzle is able to compensate, turn off the third nozzle, and operate the second nozzle at a higher firing frequency to compensate for the third nozzle. Nozzles may be arranged on printheads, for example in a symmetric arrangement, e.g. to provide a 2× nozzle redundancy and to enable the nozzles to compensate for each other (as described further below) or in another arrangement that enables image points intended for printing by a particular nozzle to be printed by a different nozzle. In some examples, each nozzle may be to compensate for another nozzle located on the same printhead, for example in subsequent passes of the printhead over a print substrate. In some examples, each nozzle may be compensated for by a plurality of other nozzles.

Nozzles that are operated at a higher frequency over time are more likely to wear out and suffer from Image Quality (IQ) issues. Over time, the drops fired by the nozzles will have a reduced drop momentum, with nozzles producing smaller drops with lower drop velocity which can cause the drop position to become inaccurate. Lower drop momentum of particular nozzles, and uneven drop momentum over the printhead can lead to alignment and image quality problems (e.g. banding errors, areas of color change, increased graininess and degraded text quality). Once this happens the printhead may need to be replaced. In this way, the apparatus of FIG. 1 can improve the usage balance between the first and second nozzles so that these nozzles wear out at a similar rate and are worn out to a similar level when the time comes to replace the printhead. In some examples, the controller can perform balancing in this manner across all of the plurality of nozzles on a printhead in an iterative fashion over time, improving the balance of usage of nozzles over the printhead. In some examples the increase in firing frequency of nozzles used for nozzle balancing may constrained to be no higher than a particular predefined value, e.g. twice the normal firing frequency.

Figure 2:
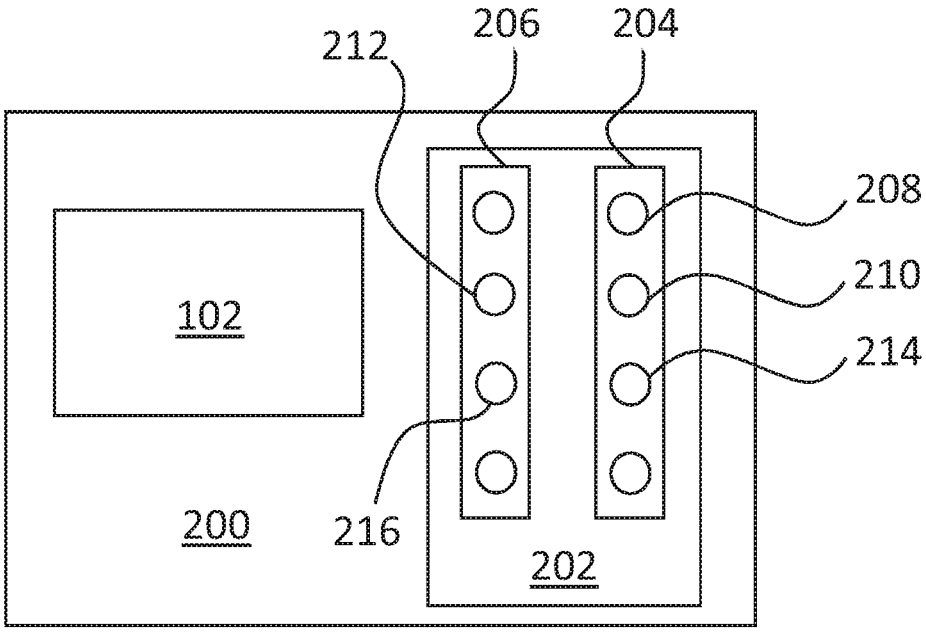
FIG. 2 shows a simplified schematic drawing of another example printing apparatus.

FIG. 2 shows another example printing apparatus 200 which also includes a controller 102 as described above in relation to FIG. 1. The printing apparatus 200 also includes a carriage 202 on which is mounted a first printhead 204 and a second printhead 206. The first and second printheads 204, 206 each have a plurality of nozzles mounted thereon which are arranged in a symmetric arrangement such that the arrangement of nozzles on the first printhead 208 mirrors the arrangement of the nozzles on the second printhead 210. Therefore for each nozzle located on the first printhead 204 there is a corresponding symmetric counterpart nozzle on the second printhead. A particular image point to be printed can be printed either by a particular nozzle on the first printhead, or by its symmetric nozzle on the second printhead, which can therefore compensate for the particular nozzle in the event of nozzle malfunction or failure. In some examples, the first and second printheads form a pair which may be mounted in a symmetric arrangement on a carriage, in some examples, with other printheads on the carriage also being mounted in a symmetric arrangement, and the overall arrangement of printheads on the carriage also being symmetric.

The first printhead 204 has a first nozzle 208 and a second nozzle 210 mounted thereon. The second printhead 206 has a third nozzle 212 mounted thereon in a location that is symmetric to the second nozzle 210. The second nozzle and the third nozzle are therefore able to compensate for each other. This arrangement enables the nozzles to compensate for each other even when the printheads are operating in a single pass printmode.

In some examples, a printing apparatus can operate in multiple different printmodes, wherein the printmode determines how many passes that the printheads make over a particular location on a print substrate. For example, the printmode may be single pass or multi-pass (with e.g. two or three passes). In different printmodes, the nozzles that are able to compensate for a particular malfunctioning nozzle may be different. For example, for the printing apparatus shown in FIG. 2, when operating in a single-pass printing mode, nozzle 214 may be compensated for or replaced by nozzle 216. In a multi-pass printing mode, nozzle 214 may be compensated for by nozzle 216 on a first pass, or by e.g. nozzle 212 or nozzle 210, which are positioned on the printheads such that they may pass over the same location as nozzle 214 on a second or future pass of the printhead (depending on printmode). Therefore, in some examples, the controller 102 is to identify a currently operational third printhead nozzle by identifying a printmode of the printing apparatus, identifying corresponding nozzles for which the second nozzle is able to compensate when the printing apparatus is operating in the identified printmode and selecting the third nozzle from the identified nozzles. Where there is a single possible option for the third nozzle, then this option is selected. Where there is more than one option available for the third nozzle in the identified printmode, the third nozzle may be selected, for example, based on a usage history of the possible third nozzles. For example, the relative usage of each of the possible third nozzles may be compared with the relative usage of other nozzles located on the same printhead as the third nozzle and a third nozzle could then be selected in order to increase the balancing of that printhead. In some examples this selection may be based on other considerations such as a nozzle position on the printhead, or a likelihood of provoking IQ defects (e.g. the method may attempt to prevent the case where a certain number of consecutive nozzles are non-operational), or the third nozzle may be randomly selected. In some examples selecting the third nozzle may comprise selecting a nozzle that has a higher usage than the second nozzle, for example when the second and third nozzles are located on the same printhead.

Taking the printmode into account when selecting a nozzle can enable the controller to take into account future usage (i.e. predicted future usage based on the printmode) as well as historic usage of the nozzles.

Figure 3:
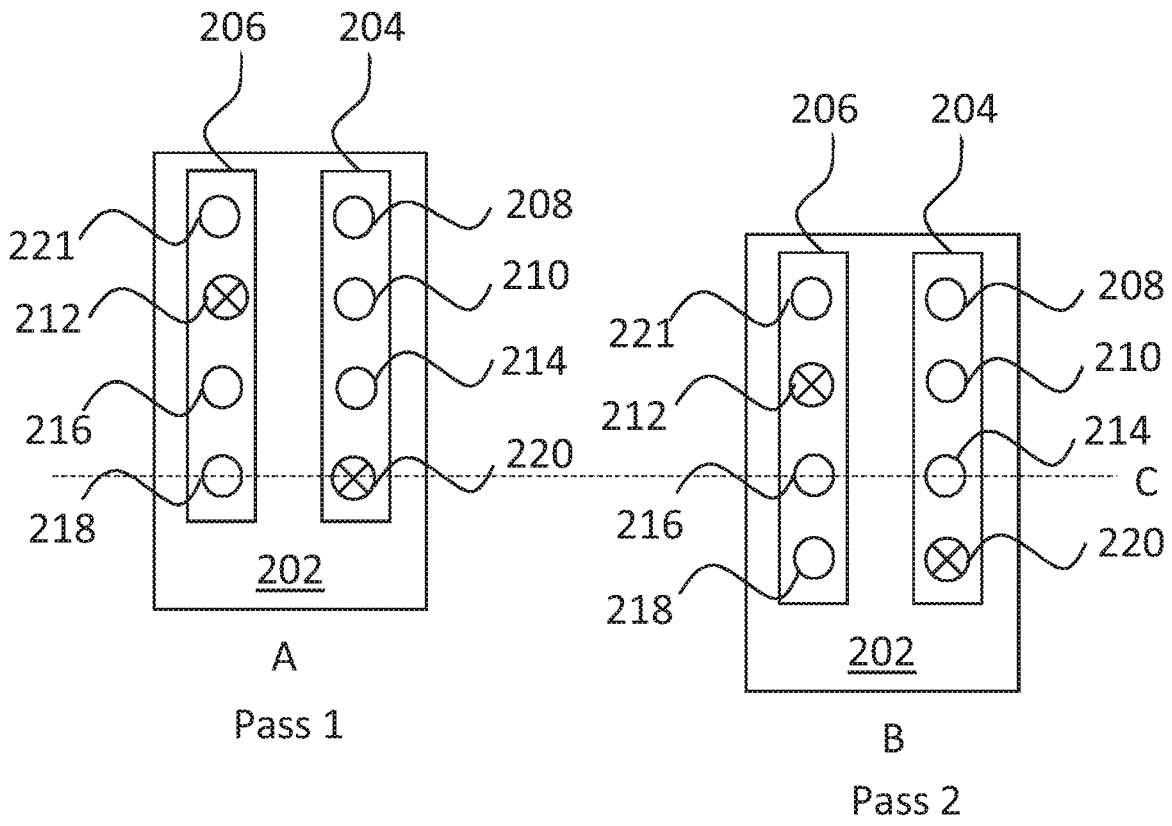
FIG. 3 shows a simplified schematic drawing of part of the example printing apparatus of FIG. 2.

FIG. 3 shows an example of the printing apparatus of FIG. 2 in use, operating in a 4-pass printmode. FIG. 3 shows the carriage 202 in position A which represents the position of the carriage 202 on a first pass over a print substrate and in position B which represents the position of the carriage 202 in a second pass over a print substrate. As indicated by line C, in the second pass, the second sequentially located nozzles 214, 216 on printheads 206 and 204 can be positioned at the same position that the first sequentially located nozzles 218, 220 were in during the first pass. In the example of FIG. 3, Nozzle 212 (the third sequential nozzle located on printhead 206) and nozzle 220 (the first sequential nozzle located on printhead 204) are not operational (for example due to malfunction of these nozzles). Nozzle 214 (the second sequential nozzle on printhead 204) is controlled to compensate, during the first pass, the image points intended for printing by nozzle 212 in the second pass. Nozzle 210 (the third sequential nozzle on printhead 204) is controlled to compensate, during the first pass, nozzle 212 failing to print failing to print in the first pass. Nozzle 218 (the first sequential nozzle on printhead 206) is controlled to compensate, in the first pass, nozzle 220 failing to print in the first pass. Nozzle 220 also fails to print in pass 2 which may also be compensated for by nozzle 218 or may be compensated for by nozzle 216 or 214 in pass 3 (not shown). Therefore, nozzles 214, 210 and 218 are all operating at twice their usual firing frequency. Nozzles 208 (the fourth sequential nozzle on printhead 204), nozzle 221 (the fourth sequential nozzle on printhead 206) and nozzle 216 are initially operating at their usual firing frequency (i.e. at half the firing frequency of nozzles 214, 210 and 218).

In order to improve the usage balance for printhead 206, operation of nozzle 208 may be suspended such that nozzle 221 operates at twice the usual firing frequency to compensate for its symmetrically located counterpart, nozzle 208. In this way, all of the working nozzles on printhead 206 are operating at the same frequency (i.e. twice the usual firing frequency) and usage of nozzles across printhead 206 is more balanced. Printhead 204 would then have two non-operational nozzles (nozzle 220 and nozzle 208) which may be balanced relative to the other nozzles on printhead 204 at a later point in time as part of an iterative balancing process.

In a later stage of the printing process, nozzles 212 and 220 may become operational again (e.g. after a recovery routine is performed). At this stage, operation of nozzle 221 may be suspended so that nozzle 208 compensates by operating at twice the usual firing frequency. Similarly, operation of nozzle 218 may be suspended and nozzle 220 may be controlled to operate at twice its usual firing frequency to improve the usage balance of printhead 204.

Figure 4:
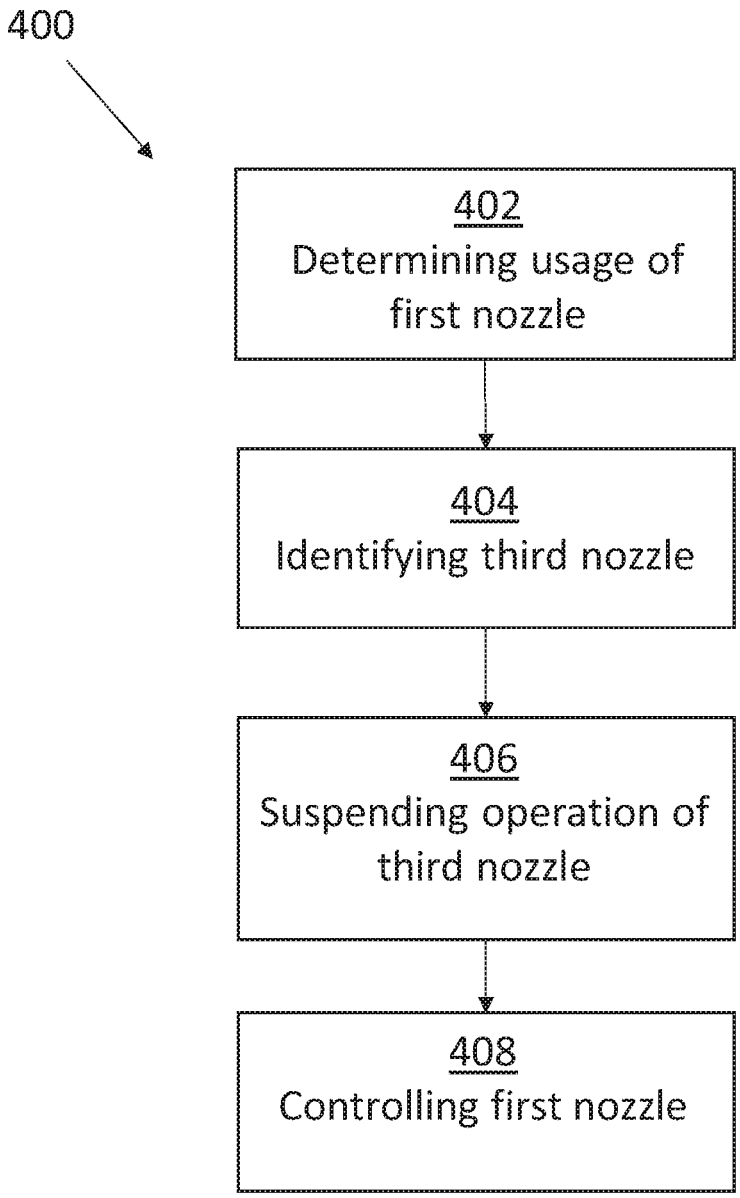
FIG. 4 is a flow chart of an example method of balancing nozzle usage of a printhead.

FIG. 4 shows a method 400, which may be a method for balancing nozzle usage of a printhead. In some examples, the method may be performed by a printing apparatus as described above in relation to FIGS. 1 and 2.

The method 400 comprises, for a pair of printheads comprising a plurality of nozzles; wherein each of the plurality of nozzles corresponds to another nozzle of the plurality of nozzles, such that a particular image point can be printed on a print substrate by either of the relevant corresponding nozzles, at block 402, determining that a first nozzle located on a first printhead of the pair of printheads has had a lower usage than a second nozzle located on the first printhead. For example, the second nozzle may be operating at a higher frequency in order to compensate for another nozzle which is malfunctioning (either temporarily or permanently), or operation of the first nozzle may have been previously suspended due to a malfunction, or to enable another nozzle to operate at a higher frequency (e.g. to balance a set of nozzles located on another printhead or another part of the same printhead) and recently turned back on. The usage may be a historic usage, i.e. a cumulative past usage of a particular nozzle.

Block 404 comprises identifying a third nozzle, wherein the third nozzle corresponds to the first nozzle. That is, the first nozzle is able to print image points intended for printing by the third nozzle. In some examples, each nozzle located on a first printhead of the pair of printheads corresponds to a nozzle located on a second printhead of the pair of printheads (e.g. the pair of printheads may have a symmetrical arrangement of nozzles).

In some examples, identifying the third nozzle comprises identifying a current printmode of the printheads and identifying a corresponding nozzle, wherein the first nozzle can print image points intended to be printed by the corresponding nozzle, while the printheads are operating in the current printmode, since different nozzles may be able to compensate for each other in different printmodes. This may provide greater options for balancing the printhead, enabling improved balancing over a plurality of iterations of the method.

In some examples, identifying the third nozzle comprises identifying a plurality of corresponding nozzles that can print image points intended to be printed by the first nozzle while operating in the current printmode and selecting a nozzle of the corresponding nozzles. In some examples this selection may be based on a historic usage of the corresponding nozzles. In some examples this selection may be based on other considerations such as based on a nozzle position on the printhead, or a likelihood of provoking IQ defects (e.g. the method may attempt to prevent the case where a certain number of consecutive nozzles are non-operational).

Block 406 comprises suspending operation of the third nozzle. Block 408 comprises controlling the first nozzle to print image points which were intended for printing by the third nozzle. For example, this may comprise modifying an internal table of the printhead that controls nozzle drop firing. In normal usage nozzles are operated at lower than their maximum drop firing frequency to enable this frequency to be increased when compensating for another nozzle.

In some examples, at a later point in time, after suspending operation of the third nozzle, the usage of the second nozzle may decrease. For example, the second nozzle may have been compensating for a malfunctioning nozzle that has become operational again, e.g. after a recovery routine has been performed or after the printhead on which the malfunctioning nozzle was located has been replaced. In this case, the method may comprise determining that the usage of the first nozzle is no longer lower than the usage of the second nozzle and returning the third nozzle to operation. In some examples, the third nozzle may be operated at a higher frequency that its usual operating frequency after being brought back into operation, to balance the relatively higher usage of other nozzles located on the same printhead, which were operating while the third nozzle was not operational.

In some examples, the method may comprise determining the usage of each of the nozzles of the plurality of nozzles on a printhead and suspending operation of relevant corresponding nozzles, such that any nozzles of the plurality of nozzles that have a lower usage than other nozzles on the same printhead will then be operated at a higher frequency to compensate. Over time, the method may be repeated in an iterative process. In some examples, the nozzle usage may be continuously adjusted and controlled, in other examples, the nozzle usage may be balanced periodically, for example after every 5 print jobs or once per hour during operation of the printing apparatus.

In some examples, the method may comprise monitoring or evaluating a health of the nozzles (either periodically or continuously) and in response to detecting a malfunctioning nozzle, operating a corresponding nozzle of the malfunctioning nozzle at an increased firing frequency to print image points which were intended for printing by both the malfunctioning nozzle and the corresponding nozzle. In some examples, the health of the nozzles may be evaluated using a drop detector, e.g. comprising an light beam emission-reception sensor which registers a signal when a drop of print agent passes through the light beam.

Figure 5:
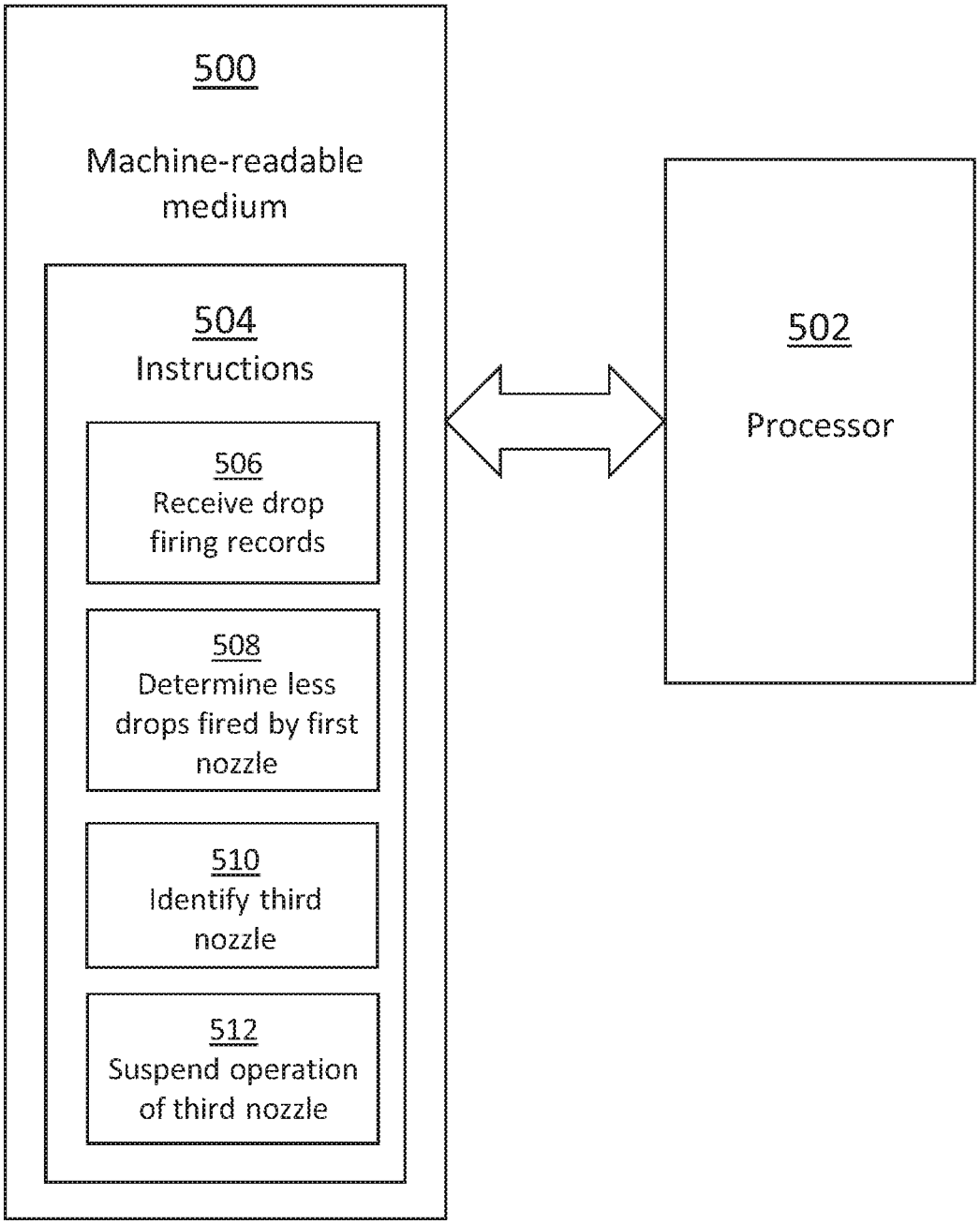
FIG. 5 shows a simplified schematic drawing of an example machine-readable medium in association with a processor.

FIG. 5 shows a tangible machine-readable medium 500 in association with a processor 502. In some examples, the machine-readable medium 500 and processor 502 may be part of a printing apparatus such as shown in FIGS. 1 and 2. The machine-readable medium 500 comprises a set of instructions 504 which, when executed by the processor 502 cause the processor 502 to control a printing apparatus. The instructions 504 may cause the processor 502 to perform the method described above in relation to FIG. 3. At block 506, the instructions are to cause the processor to receive drop firing records for a plurality of printhead nozzles. At block 508, the instructions are to determine that a first nozzle of the plurality of printhead nozzles has fired less drops than a second nozzle located on a same printhead as the first nozzle. At block 510, the instructions are to identify a third nozzle of the plurality of printhead nozzles, wherein the first nozzle is to compensate for the third nozzle in the event of a malfunction of the third nozzle. At block 512 the instructions are to suspend operation of the third nozzle and operate the first nozzle with an increased drop firing frequency to compensate for the suspended operation of the third nozzle.

In some examples, the machine-readable medium may comprise instructions to control the printing apparatus to periodically evaluate usage of each of the plurality of printhead nozzles based on the received drop firing records and in some examples, in response to detecting uneven usage of the nozzles, the instructions are to cause the processor to control the printing apparatus to iteratively balance the usage of nozzles located on the same printhead. That is, the instructions may cause the processor to periodically balance the usage of nozzles on a particular printhead, e.g. after a predefined number of print jobs has been printed or after a particular time period has passed.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

It shall be understood that some blocks in the flow charts can be realized using machine readable instructions, such as any combination of software, hardware, firmware or the like. Such machine readable instructions may be included on a computer readable storage medium (including but not limited to disc storage, CD-ROM, optical storage, etc.) having computer readable program codes therein or thereon.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode. Further, some teachings herein may be implemented in the form of a computer software product, the computer software product being stored in a storage medium and comprising a plurality of instructions for making a computer device implement the methods recited in the examples of the present disclosure.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features oaf any of the independent claims or other dependent claims.

What is claimed is:

1. A printing apparatus comprising a controller, wherein the controller is to:

compare a historic usage of a first printhead nozzle with a historic usage of a second printhead nozzle which is located on a same printhead as the first nozzle;

determine that the historic usage of the first nozzle is higher than the historic usage of the second nozzle, and in response:

identify a currently operational third printhead nozzle on a different printhead, for which the second nozzle is able to compensate; and turn off the third nozzle, and operate the second nozzle in place of the third nozzle at a higher firing frequency to compensate for the third nozzle.

2. A printing apparatus according to claim 1, further comprising first and second printheads, having a plurality of nozzles in a symmetric arrangement, wherein the first and second nozzles are located on the first printhead.

3. A printing apparatus according to claim 2 wherein the third nozzle is located on the second printhead.

4. A printing apparatus according to claim 1 wherein identifying a currently operational third printhead nozzle comprises:

identifying a printmode of the printing apparatus;

identifying corresponding nozzles for which the second nozzle is able to compensate when the printing apparatus is operating in the identified printmode; and selecting the third nozzle from the identified nozzles.

5. A printing apparatus according to claim 4, wherein the printmode indicates a number of passes to be performed by the printhead in producing a printed product.

6. A printing apparatus according to claim 1, wherein the controller is to:

operate the first printhead nozzle at a higher firing frequency in response to detecting a malfunctioning nozzle for which the first printhead nozzle is able to compensate.

7. A printing apparatus according to claim 1, wherein the printing apparatus is to track usage of each of a plurality of nozzles over its lifetime.

8. A printing apparatus according to claim 1, wherein the second nozzle is operated in place of the third nozzle to reduce a difference in usage between the first nozzle and the second nozzle.

9. A method comprising, for a pair of printheads comprising a plurality of nozzles, wherein each of the plurality of nozzles corresponds to another nozzle of the plurality of nozzles, such that a particular image point can be printed on a print substrate by either of the relevant corresponding nozzles;

determining that a first nozzle located on a first printhead of the pair of printheads has had a lower usage than a second nozzle located on the first printhead;

identifying a third nozzle on a second printhead, wherein the third nozzle corresponds to the first nozzle;

suspending operation of the third nozzle; and controlling the first nozzle to print image points which were intended for printing by the third nozzle.

10. A method according to claim 9 wherein identifying the third nozzle comprises identifying a corresponding nozzle having a higher usage than the first nozzle.

11. A method according to claim 9, wherein identifying the third nozzle comprises:

identifying a current printmode of the printheads; and identifying a corresponding nozzle, wherein the first nozzle can print image points intended to be printed by the corresponding nozzle, while the printheads are operating in the current printmode.

12. A method according to claim 11 wherein identifying the third nozzle comprises:

identifying a plurality of corresponding nozzles that can print image points intended to be printed by the first nozzle while operating in the current printmode; and selecting a nozzle of the corresponding nozzles based on a historic usage of the corresponding nozzles.

13. A method according to claim 9, further comprising:

evaluating a health of each of the plurality of nozzles; and, in response to detecting a malfunctioning nozzle, operating a corresponding nozzle of the malfunctioning nozzle at an increased firing frequency to print image points which were intended for printing by both the malfunctioning nozzle and the corresponding nozzle.

14. A method according to claim 9, further comprising, after suspending operation of the third nozzle, determining that usage of the first nozzle has become the same or higher than the second nozzle, and in response returning the third nozzle to operation.

15. A method according to claim 9, wherein the first nozzle is operated in place of the third nozzle to reduce a difference in usage between the first nozzle and the second nozzle.

16. A tangible machine-readable medium comprising a set of instructions which, when executed by a processor cause the processor to control a printing apparatus to:

receive drop firing records for a plurality of printhead nozzles;

determine that a first nozzle of the plurality of printhead nozzles has fired less drops than a second nozzle located on a same printhead as the first nozzle;

identify a third nozzle of the plurality of printhead nozzles on a different printhead, wherein the first nozzle is to compensate for the third nozzle in the event of malfunction of the third nozzle; and suspend operation of the third nozzle and operate the first nozzle with an increased drop firing frequency to compensate for the suspended operation of the third nozzle.

17. A tangible machine-readable medium according to claim 16 wherein the set of instructions cause the processor to control the printing apparatus to periodically evaluate usage of each of the plurality of printhead nozzles based on the received drop firing records.

18. A tangible machine-readable medium according to claim 17 wherein the set instructions cause the processor to control the printing apparatus to iteratively balance the usage of nozzles located on the same printhead in response to detecting uneven usage of those nozzles.

19. A tangible machine-readable medium according to claim 16, wherein the first nozzle is operated in place of the third nozzle to reduce a difference in usage between the first nozzle and the second nozzle.

* * * * *